US009118117B2

(12) United States Patent
Chen et al.

(10) Patent No.: US 9,118,117 B2
(45) Date of Patent: Aug. 25, 2015

(54) RECEIVING AND TRANSMITTING DEVICE FOR WIRELESS TRANSCEIVER

(71) Applicant: SOUTHERN TAIWAN UNIVERSITY OF SCIENCE AND TECHNOLOGY, Tainan (TW)

(72) Inventors: Wen-Shan Chen, Tainan (TW); Yuan-Chih Lin, Tainan (TW); Ke-Ming Lin, Tainan (TW)

(73) Assignee: Southern Taiwan University of Science and Technology, Tainan (TW)

( * ) Notice: Subject to any disclaimer, the term of this patent is extended or adjusted under 35 U.S.C. 154(b) by 186 days.

(21) Appl. No.: 14/057,196

(22) Filed: Oct. 18, 2013

(65) Prior Publication Data

US 2015/0109182 A1 Apr. 23, 2015

(51) Int. Cl.
*H01Q 1/52* (2006.01)
*H01Q 21/28* (2006.01)

(52) U.S. Cl.
CPC ..... *H01Q 1/525* (2013.01); *H01Q 21/28* (2013.01)

(58) Field of Classification Search
CPC ..... H01Q 1/243; H01Q 1/525; H01Q 21/28
USPC ..... 343/702, 833, 834, 841
See application file for complete search history.

(56) References Cited

U.S. PATENT DOCUMENTS

| | | | | |
|---|---|---|---|---|
| 7,358,906 | B2 * | 4/2008 | Sato et al. | 343/702 |
| 7,589,680 | B2 * | 9/2009 | Tsai et al. | 343/702 |
| 8,823,594 | B2 * | 9/2014 | Hamabe | 343/725 |
| 9,013,358 | B2 * | 4/2015 | Hsu | 343/702 |

FOREIGN PATENT DOCUMENTS

TW 201117472 A1 5/2011

* cited by examiner

*Primary Examiner* — Michael C Wimer
(74) *Attorney, Agent, or Firm* — Rosenberg, Klein & Lee

(57) ABSTRACT

A receiving and transmitting device for wireless transceivers is revealed. The device has been developed from a high isolation MIMO (multiple-input multiple-output) antenna used for 2.45 GHz WLAN operation. The antenna is a dual-fed coupled monopole MIMO antenna that includes a dielectric substrate and a MIMO antenna. A grounding portion with two signal ends for feeding signals is disposed on the dielectric substrate. A T-shaped metal plate is extended from the grounding portion and located between two signal ends. A C-shaped parasitic element is arranged at the metal plate and there is a certain distance therebetween so as to adjust the isolation. The antenna is symmetrical for improving isolation and is suitable for USB dongles or small-sized wireless mobile devices.

8 Claims, 14 Drawing Sheets

RECEIVING AND TRANSMITTING DEVICE FOR WIRELESS TRANSCEIVER

BACKGROUND OF THE INVENTION

1. Fields of the Invention

The present invention relates to a receiving and transmitting device for wireless transceivers, especially to a multiple-input multiple-output (MIMO) antenna used for WLAN operation. Good isolation is achieved by adjusting the distance between a radiating portion and a parasitic element of the present invention, without using any active or passive component.

2. Descriptions of Related Art

Nowadays a MIMO antenna is used to increase the isolation between antennas. Generally, the isolation is improved by increasing the distance between the two antennas, different polarization directions of the antennas, or adding isolation components on a dielectric substrate. For example, a band reject filter is disposed between two antennas so as to increase the isolation.

Although the isolation is improved by increasing the distance between the antennas, the size of the antenna is increased relatively. The size of the antenna is unable to be minimized. As to different polarization directions of the antennas, the radiation patterns generated are not symmetric. Moreover, there is still a dead angle of communication and this lead to poor communication quality. The arrangement of the band reject filter improves the isolation of antennas. But the volume of the antennas is unable to be reduced on the ground plane. The manufacturing cost and difficulty in circuit design are also increased.

Moreover, refer to Taiwanese Pat. Pub. No. 201117472, a dual-band printed circuit antenna for electronics is revealed. The antenna is a monopole antenna with a quarter wavelength ($\lambda/4$) in length at low frequency/three-quarter wavelength (3═/4) in length at high frequency so as to increase band width of high frequency signals. Moreover, the position of the feed point is selected under the condition that a plurality of antennas shares the same ground point. Thus the frequency band at high frequency has good isolation, radiation efficiency and band width.

Wireless devices have become essentials on our daily lives due to fast development of wireless communication technology. Thus various new antennas have been invented for fast catch-up of information at all times and all places. Even under terrible environment, the quality of signals received is good and the transmission speed is high.

Thus there is a need to provide a receiving and transmitting device for wireless transceivers with a simple structure for getting good isolation and avoiding interference problems when the two antennas are quite close to each other.

SUMMARY OF THE INVENTION

Therefore it is a primary object of the present invention to provide a receiving and transmitting device for wireless transceivers in which a parasitic element is disposed over an antenna. Good isolation is achieved by adjusting a distance between the antenna and the parasitic element and no active or passive component is used. Moreover, the receiving and transmitting device is suitable for USB dongles or small-sized wireless mobile devices.

In order to achieve the above objects, a receiving and transmitting device for wireless transceivers of the present invention includes a grounding portion, a radiating portion, a parasitic element, a first feed body and a second feed body, all arranged at a substrate.

The grounding portion is on one surface of the substrate.

The radiating portion consists of a vertical extension segment extended from top of the grounding portion, a first horizontal extension segment and a second horizontal extension segment respectively extended from one end of the vertical extension segment away from the grounding portion and toward opposite directions, a first radiation segment and a second radiation segment respectively extended from one end of the first horizontal extension segment away from the vertical extension segment and one end of the second horizontal extension segment away from the vertical extension segment. There is a first spacing distance between the first radiation segment and the grounding portion. And a second spacing distance is between the second radiation segment and the grounding portion.

The parasitic element is set over the radiating portion and there is a first coupling gap formed between the parasitic element and the radiating portion. The parasitic element has an upward opening and a second coupling gap is formed on the opening.

The first feed body is arranged in an area surrounded by the vertical extension segment, the first horizontal extension segment, the first radiation segment and the grounding portion, with a certain gap therebetween. A first feed point for feeding signals is disposed between the first feed body and the grounding portion.

The second feed body is disposed in an area surrounded by the vertical extension segment, the second horizontal extension segment, the second radiation segment and the grounding portion, with a certain gap therebetween. A second feed point for feeding signals is disposed between the second feed body and the grounding portion.

In the above receiving and transmitting device for wireless transceivers, the parasitic element is C-shaped.

A coaxial line or a monopole antenna is used at the first feed point and the second feed point.

The first radiation segment and the second radiation segment are resonant second modes and the resonant length is a half wavelength.

The dominant mode of the parasitic element is half wavelength long.

The present invention has following advantages:

1. The cost is reduced and the production is easy due to the use of planar printed antennas. Moreover, the planar printed antenna can be applied to various small-sized conveniently.

2. No active or passive component is required in the antenna of the present invention. Good isolation is achieved only by adjusting the distance between the antenna of the present invention and the parasitic element.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
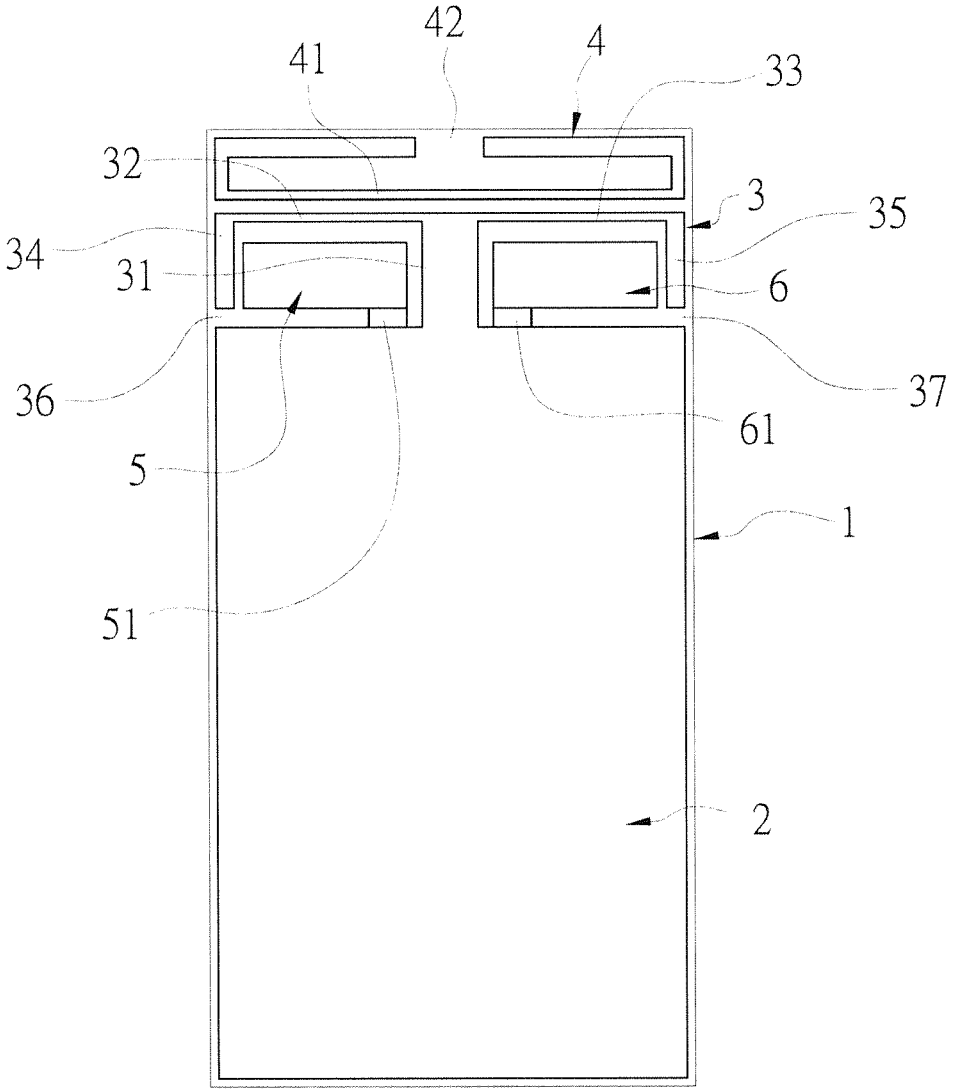
FIG. 1 is a schematic drawing showing structure of an antenna according to the present invention.

Refer to FIG. 1, a receiving and transmitting member for wireless transceivers is a dual-fed coupled monopole MIMO antenna. The antenna includes a grounding portion 2, a radiating portion 3, a parasitic element 4, a first feed body 5, and a second feed body 6, all disposed over a substrate 1. The substrate 1 is a FR4 glass fiber board with a thickness of 1.6 mm, relative permittivity of 4.4, and loss tangent of 0.0245. The grounding portion 2 is located on one surface of the substrate 1.

The radiating portion 3 consists of a vertical extension segment 31, a first horizontal extension segment 32, a second horizontal extension segment 33, a first radiation segment 34, and a second radiation segment 35. The vertical extension segment 31 is extended from top of the grounding portion 2. The first horizontal extension segment 32 and the second horizontal extension segment 33 are extended from one end of the vertical extension segment 31 away from the grounding portion 2 and respectively toward opposite directions. The first radiation segment 34 and the second radiation segment 35 are respectively extended from one end of the first horizontal extension segment 32 away from the vertical extension segment 31 and one end of the second horizontal extension segment 33 away from the vertical extension segment 31. A first spacing distance 36 is between the first radiation segment 34 and the grounding portion 2 while a second spacing distance 37 is between the second radiation segment 35 and the grounding portion 2. Moreover, the first radiation segment 34 and the second radiation segment 35 are resonant second modes and the resonant is a half wavelength.

The parasitic element 4 is located over the radiating portion 3 and there is a first coupling gap 41 between the parasitic element 4 and the radiating portion 3. The parasitic element 4 has an upward opening and a second coupling gap 42 is formed on the opening. Thus the parasitic element 4 is C-shaped and the dominant mode thereof is half wavelength long.

The first feed body 5 is arranged in an area surrounded by the vertical extension segment 31, the first horizontal extension segment 32, the first radiation segment 34 and the grounding portion 2, with a gap therebetween. A first feed point 51 for feeding signals is disposed between the first feed body 5 and the grounding portion 2. A coaxial line or a monopole antenna is used at the first feed point 51.

The second feed body 6 is disposed in an area surrounded by the vertical extension segment 31, the second horizontal extension segment 33, the second radiation segment 35 and the grounding portion 2, with a gap therebetween. A second feed point 61 for feeding signals is disposed between the second feed body 6 and the grounding portion 2. A coaxial line or a monopole antenna is used at the second feed point 61.

Figure 2:
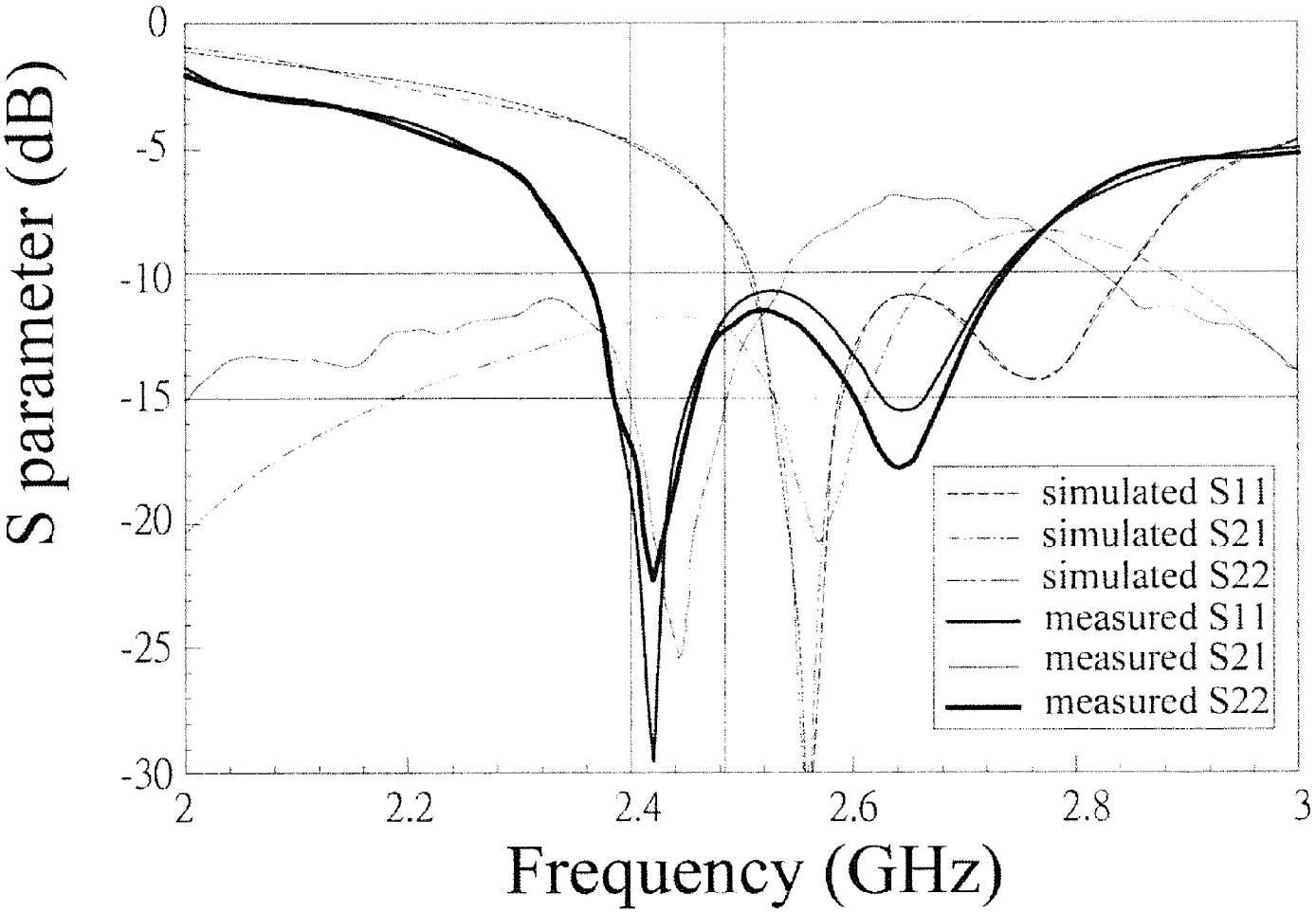
FIG. 2 shows measured and simulated S-parameter data of an antenna according to the present invention.

FIG. 2 shows measured and simulated S parameter data of the antenna according to the resent invention. The parameters S11 and S22 represent return losses of the first antenna and the second antenna respectively. The parameter S21 represents the isolation between the first antenna and the second antenna. For the parameters S11 and S22 as shown in FIG. 2, the lower the ratio, the less the loss; for the parameter S21 as shown in FIG. 2, the lower the ratio, the better the isolation. Refer to FIG. 2, it is learned that the measured results of the antenna of the present invention meet the bandwidth requirement for 2.4 GHz WLAN operation. The measured results are quite close to the mode representation of the antenna.

Figure 3:
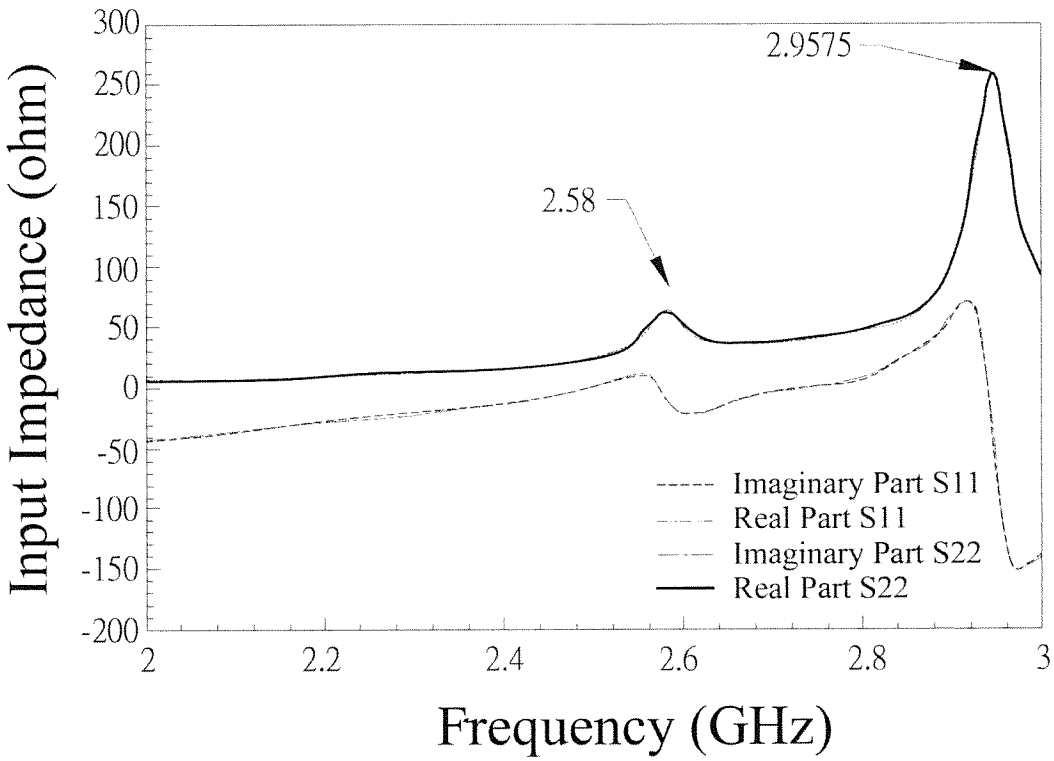
FIG. 3 shows measured and simulated Z-parameter data of an antenna according to the present invention.

FIG. 3 shows measured and simulated Z parameter data of the antenna according to the resent invention. Compared FIG. 3 with FIG. 2, it is clear that two modes are excited at 2.4 GHz-2.484 GHz and resonant. As to the simulated band of the antenna, two resonant modes are shown at 2.58 GHz and 2.9575 GHz.

Figure 4:
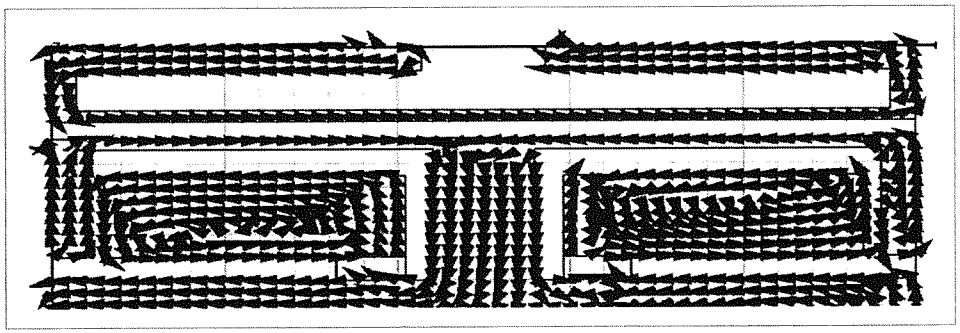
FIG. 4 is a schematic drawing showing simulated current distribution at 2.58 GHz of an antenna according to the present invention.

FIG. 4 shows current distribution of the mode at 2.58 GHz. Compare FIG. 4 with FIG. 3, it is learned that at that frequency, a resonant path for the excitation of the mode corresponds to a half wavelength. The mode is generated by coupling to the C-shaped parasitic element 4 and isolation is achieved between two antennas.

Figure 5:
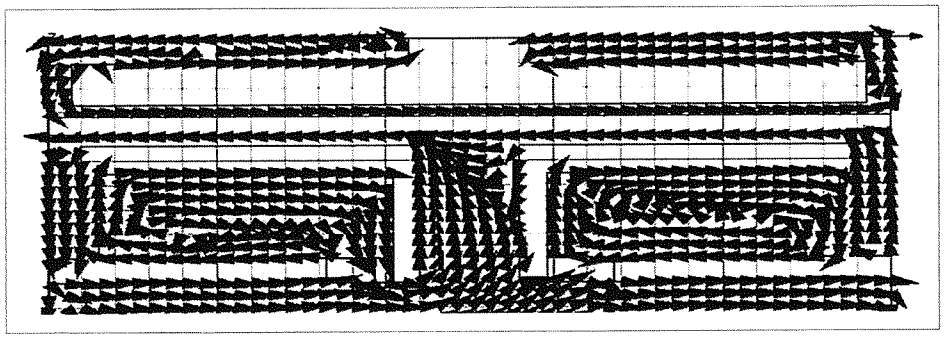
FIG. 5 is a schematic drawing showing simulated current distribution at 2.9575 GHz of an antenna according to the present invention.
Figure 6:
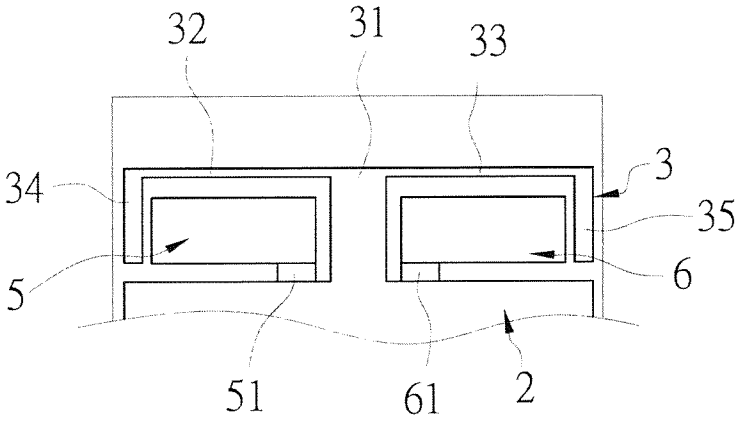
FIG. 6 is a schematic drawing showing structure of an antenna without a C-shaped parasitic element.
Figure 7:
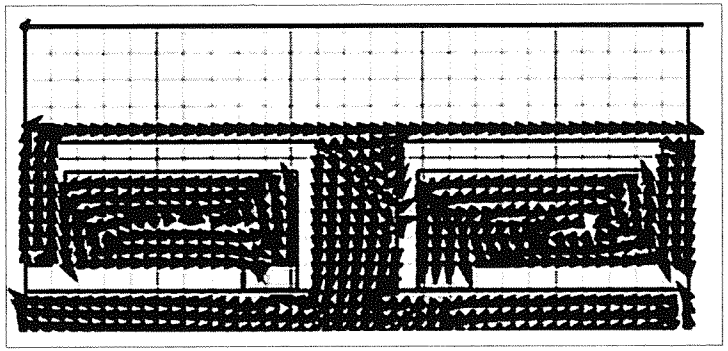
FIG. 7 is a schematic drawing showing simulated current distribution at 2.99 GHz of an antenna without a C-shaped parasitic element.
Figure 8:
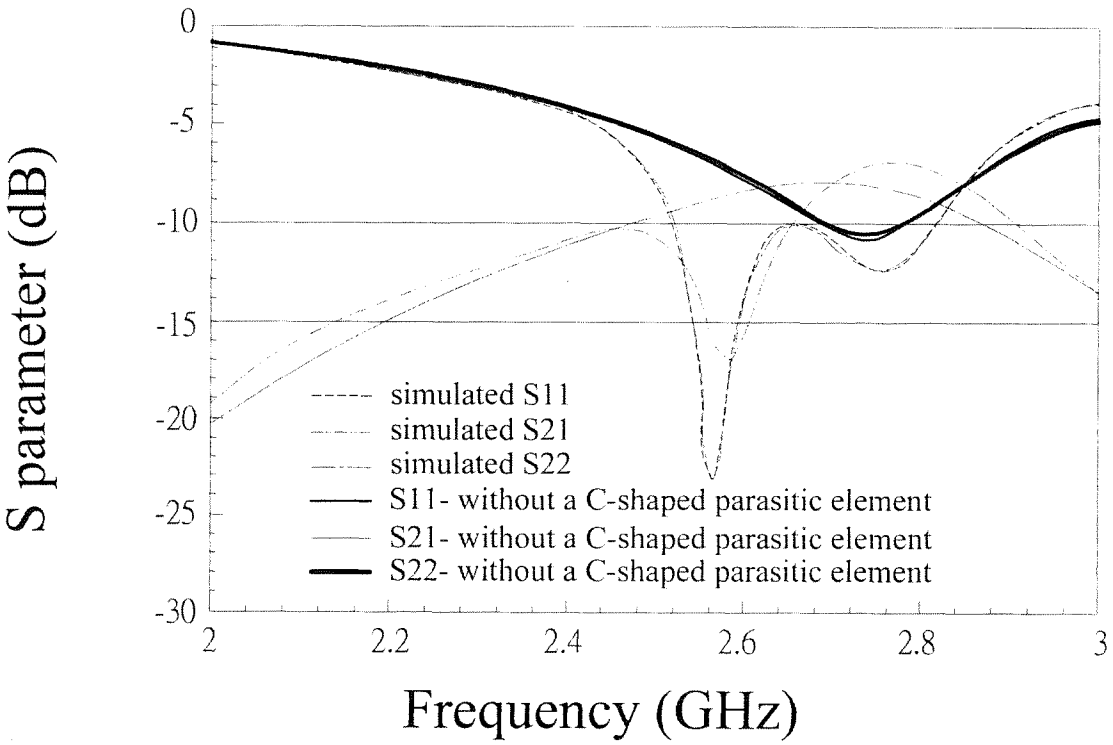
FIG. 8 shows measured and simulated S-parameter data of an antenna without a C-shaped parasitic element.
Figure 9:
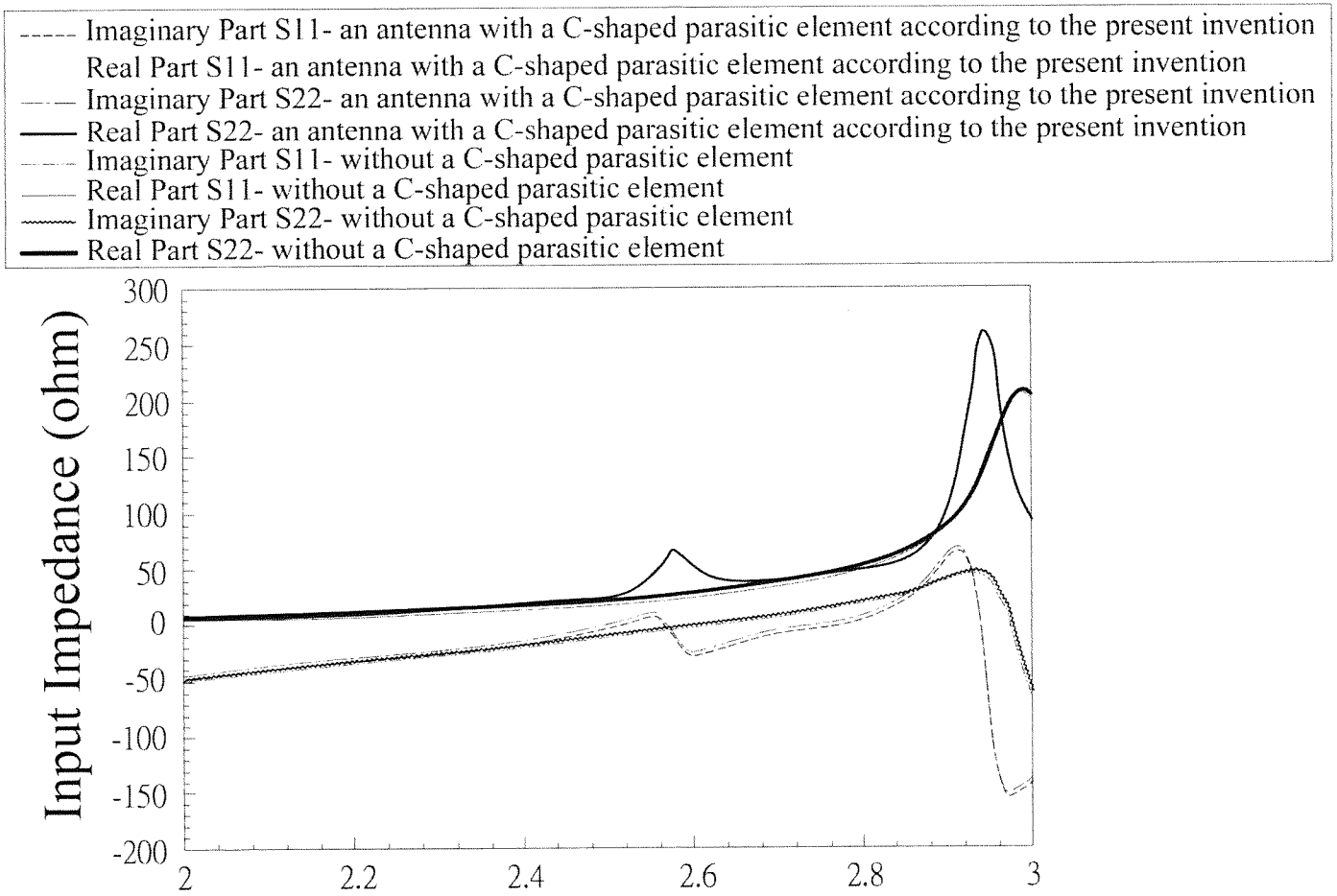
FIG. 9 shows measured and simulated Z-parameter data of an antenna without a C-shaped parasitic element.

FIG. 5 shows simulated current distribution of the antenna at 2.58 GHz mode. This is a higher mode generated due to coupling of the radiating portion 3 with an extension portion including the first feed body 5, the second feed body 6, the vertical extension segment 31, the first horizontal extension segment 32, the second horizontal extension segment 33, the first radiation segment 34, the second radiation segment 35, the first spacing distance 36, and the second spacing distance 37. Refer from FIG. 6 to FIG. 9, antenna structure, simulated current distribution, simulated S parameter data and simulated Z parameter data of an antenna without being disposed with the C-shaped parasitic element 4 are revealed. At the 2.99 GHz, as real and imaginary impedances shown in FIG. 9, there is no resonance at a lower mode of this point. Refer to FIG. 7 showing simulated current distribution, the main simulated current is generated by the C-shaped parasitic element 4. Thus the isolation between the two antennas is generated due to the C-shaped parasitic element 4. The radiation effect at the frequency band also occurs.

Figure 10:
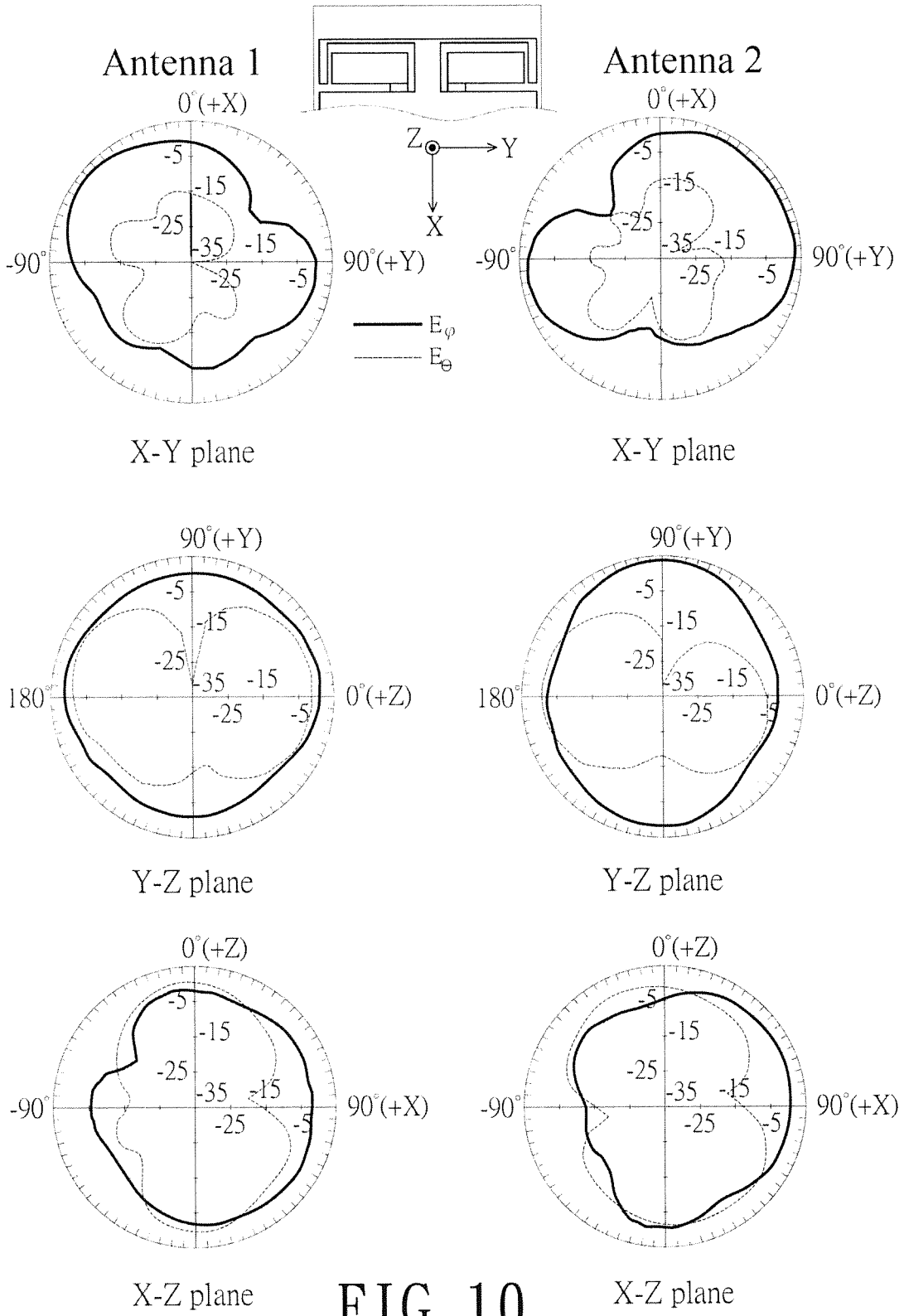
FIG. 10 shows simulated far-field radiation patterns at 2.54 GHz of an antenna according to the present invention.
Figure 11:
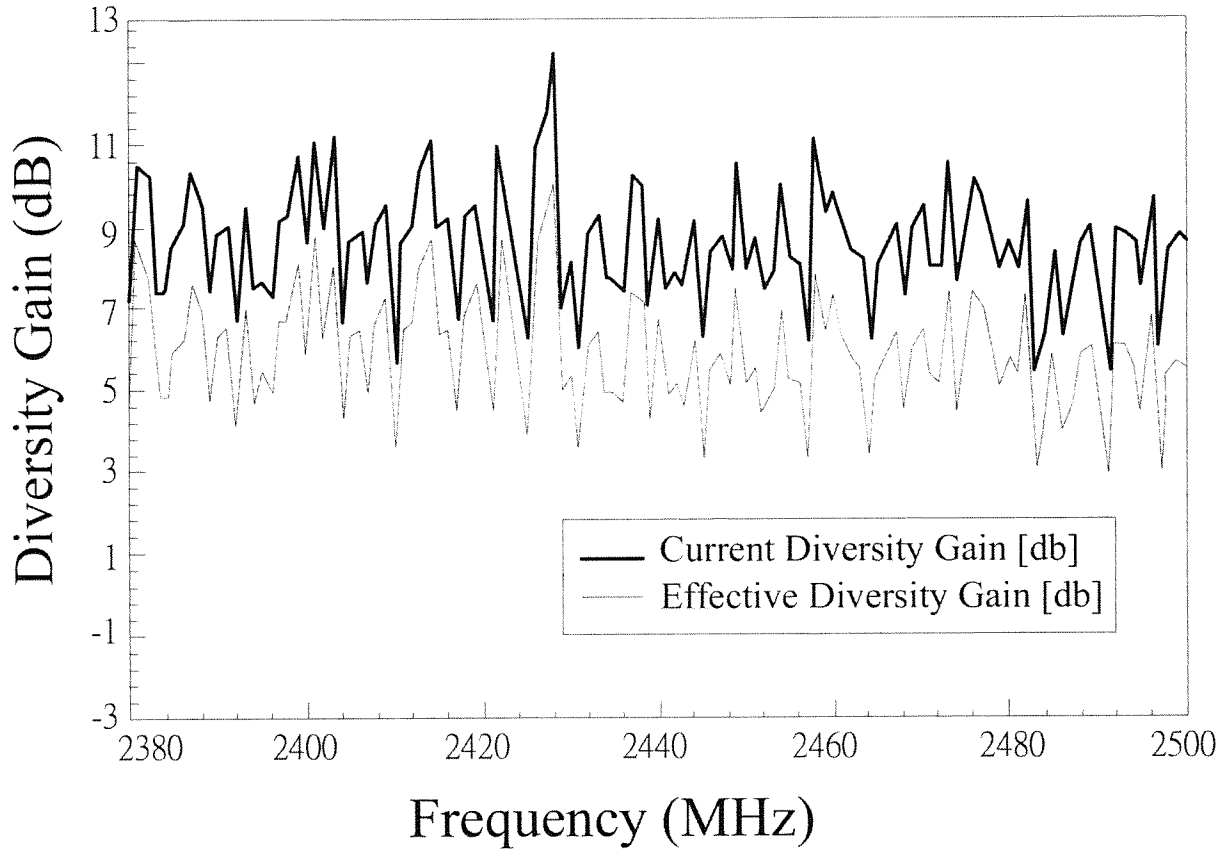
FIG. 11 shows measured data of diversity gain of an antenna according to the present invention.
Figure 12:
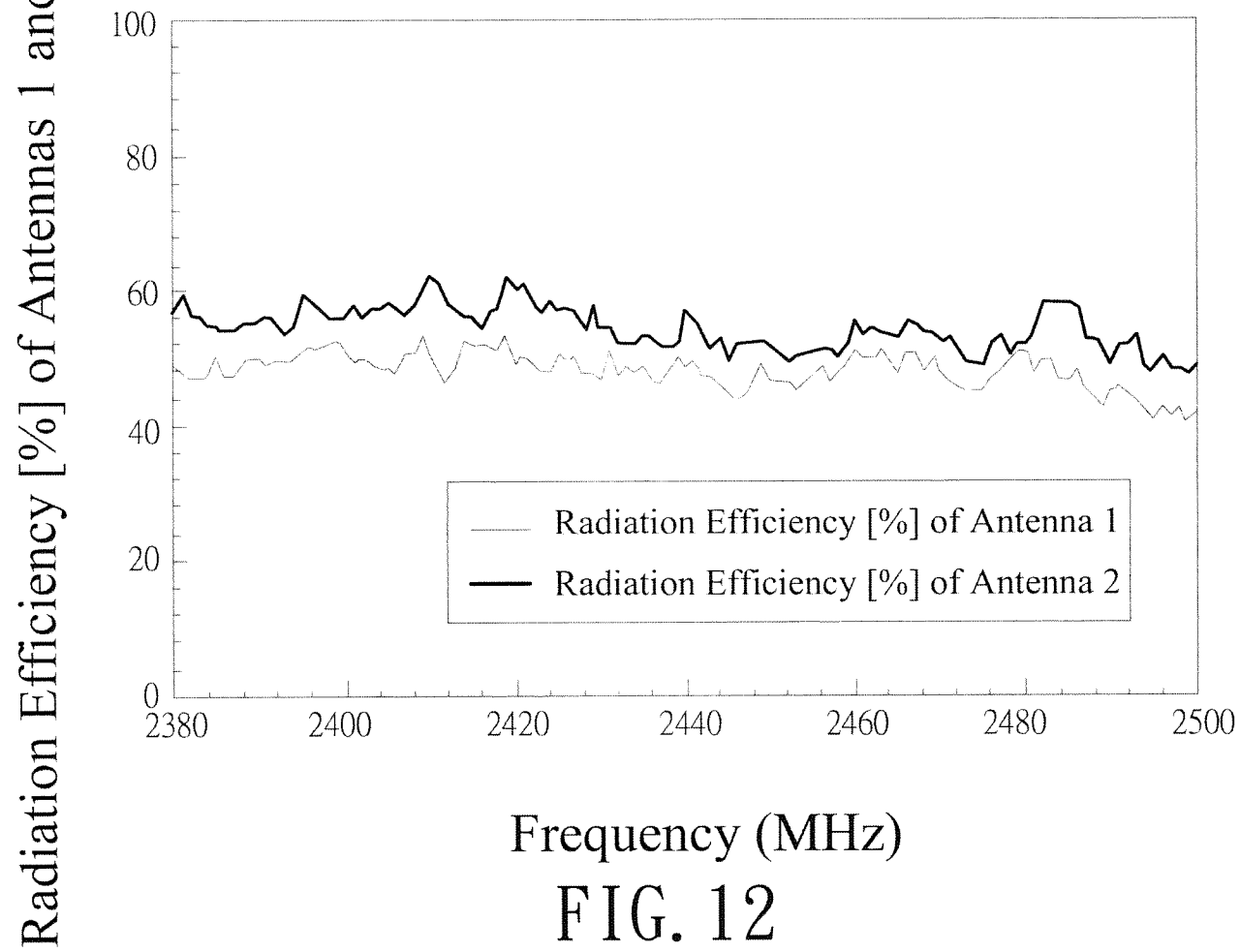
FIG. 12 shows measured radiation efficiency of an antenna according to the present invention.

Refer to FIG. 10, it shows simulated far-field radiation patterns of the present invention at 2.54 GHz. As shown in figure, the antenna of the present invention has a symmetrical structure (the left is the antenna one and the right is the antenna two) so as to generate diversity radiation pattern that is left-right symmetric. There are two obvious space diversity effects generated in the diversity radiation pattern of the antenna of the present invention in MIMO technology. Moreover, the transmission efficiency and transmission capacity are both increased. The antenna of the present invention has omni-directional radiation patterns so that the transmission is improved.

Figure 13:
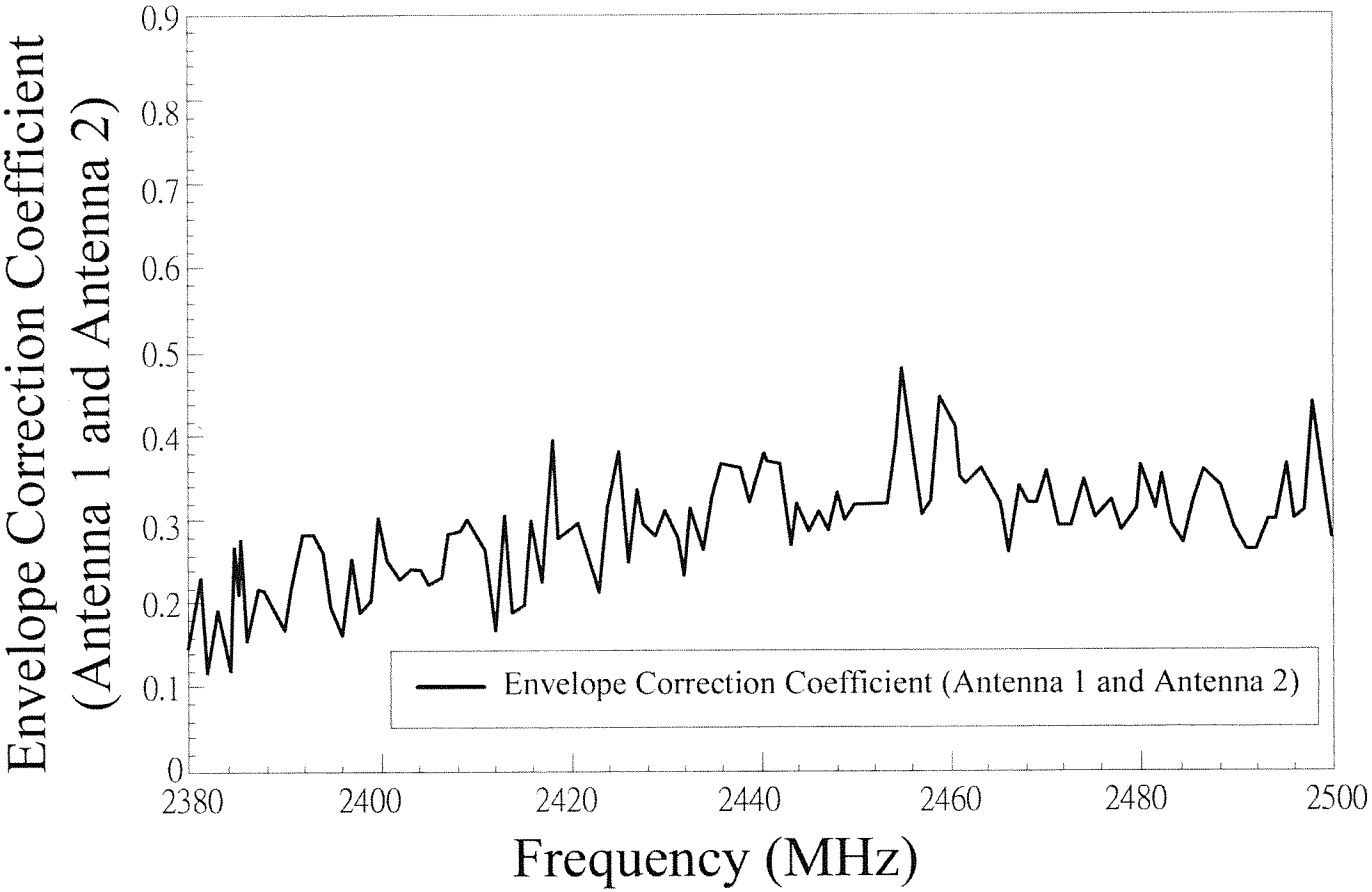
FIG. 13 shows measured envelope correction coefficient (ECC) of an antenna according to the present invention.
Figure 14:
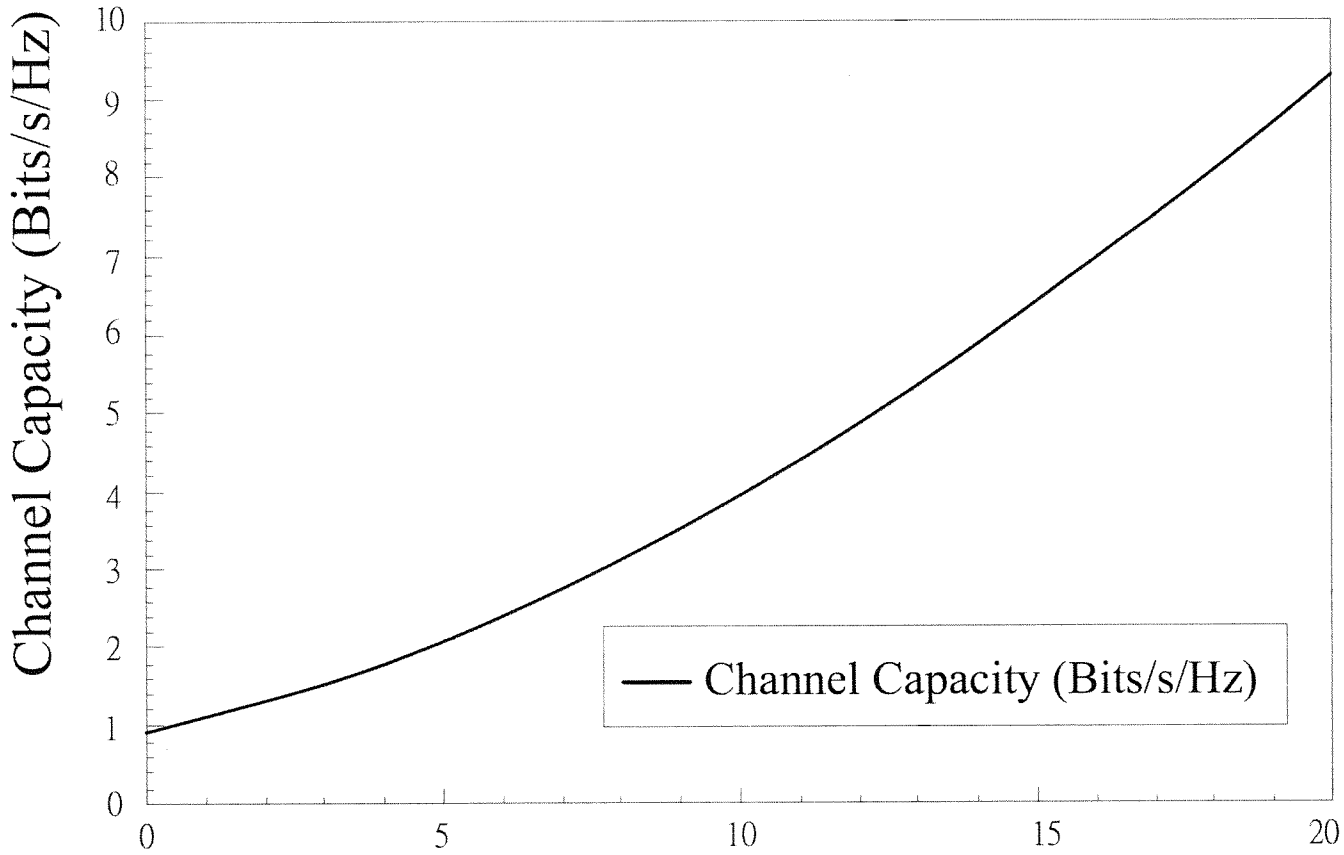
FIG. 14 shows measured data of MIMO channel capacity of an antenna according to the present invention.

FIG. 11 to FIG. 14 respectively show measured data of diversity gain and measured radiation efficiency of the antenna according to the present invention. It is obvious in FIG. 11 that within the operation band, the diversity gain is about 3.18 dB to 6.5 dB larger than that of a single antenna. Refer to the measured radiation efficiency of the antenna in FIG. 12, the radiation efficiency of the antenna according to the present invention is over 50%. For small-sized MIMO antenna, such efficiency is acceptable in the field. FIG. 13 shows measured envelope correction coefficient (ECC) of the antenna. In the operation of IEEE 802.11n, the maximum value of the envelope data is 0.42 while the minimum value is about 0.18. Thus the measured ECC of the antenna according to the present invention shows good isolation within the present operation band. And the good isolation can also be learned by the diversity gain. Refer to FIG. 14, it shows measured results of MIMO channel capacity of the antenna according to the present invention. Compared a dipole antenna with the MIMO antenna of the present invention, the channel capacity of the MIMO antenna is increased to about two times. Under the condition that the radiation efficiency of the MIMO antenna is over 50% and the SNR is 20 dB, there is only a bit difference in capacity between the MIMO antenna and the multi-antenna/or array antenna. When SNR is 20 dB, the spectral efficiency of the antenna of the present invention is 9.2 bit/s/Hz. Therefore the antenna of the present invention has good transmission efficiency and also meets requirements as well as specification of the MIMO system.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A receiving and transmitting device for wireless transceivers comprising a grounding portion, a radiating portion, a parasitic element, a first feed body, and a second feed body, all arranged at a substrate; wherein the grounding portion is on one surface of the substrate;

the radiating portion having a vertical extension segment extended from top of the grounding portion, a first horizontal extension segment and a second horizontal extension segment respectively extended from one end of the vertical extension segment away from the grounding portion and toward opposite directions, a first radiation segment and a second radiation segment respectively extended from one end of the first horizontal extension segment away from the vertical extension segment and one end of the second horizontal extension segment away from the vertical extension segment; there is a first spacing distance between the first radiation segment and the grounding portion while a second spacing distance is between the second radiation segment and the grounding portion;

the parasitic element having an upward opening is arranged over the radiating portion and there is a first coupling gap formed between the parasitic element and the radiating portion while a second coupling gap is formed on the opening;

the first feed body is arranged in an area surrounded by the vertical extension segment, the first horizontal extension segment, the first radiation segment and the grounding portion, with a gap therebetween while a first feed point for feeding signals is disposed between the first feed body and the grounding portion;

the second feed body is disposed in an area surrounded by the vertical extension segment, the second horizontal extension segment, the second radiation segment and the grounding portion, with a gap therebetween while a second feed point for feeding signals is disposed between the second feed body and the grounding portion.

2. The device as claimed in claim 1, wherein the parasitic element is C-shaped.

3. The device as claimed in claim 1, wherein a coaxial line or a monopole antenna is used at the first feed point and the second feed point.

4. The device as claimed in claim 2, wherein a coaxial line or a monopole antenna is used at the first feed point and the second feed point.

5. The device as claimed in claim 3, wherein the first radiation segment and the second radiation segment are resonant second modes and the resonant length is a half wavelength.

6. The device as claimed in claim 4, wherein the first radiation segment and the second radiation segment are resonant second modes and the resonant length is a half wavelength.

7. The device as claimed in claim 5, wherein a dominant mode of the parasitic element is half wavelength long.

8. The device as claimed in claim 6, wherein a dominant mode of the parasitic element is half wavelength long.

* * * * *